United States Patent [19]

Cordell

[11] Patent Number: 4,923,108

[45] Date of Patent: May 8, 1990

[54] PROCESS FOR INTERNALLY STRENGTHENING TUBES

[76] Inventor: Steve Cordell, 3317 Cardiff Ave., Los Angeles, Calif. 90034

[21] Appl. No.: 268,569

[22] Filed: Nov. 8, 1988

[30] Foreign Application Priority Data

Nov. 16, 1987 [DE] Fed. Rep. of Germany ..... 3738813

[51] Int. Cl.[5] ..... B23K 31/00; B23K 31/06

[52] U.S. Cl. ..... 228/126; 228/132; 228/245; 138/172; 138/DIG. 5; 29/446; 29/897.35; 156/165

[58] Field of Search ..... 228/126, 131, 132, 182; 29/155 C, 446; 138/114, 148, 153, 172, DIG. 5; 182/217; 52/738, 731; 156/144, 165

[56] References Cited

U.S. PATENT DOCUMENTS

| | | | |
|---|---|---|---|
| 724,909 | 4/1903 | Maxwell | 138/172 |
| 908,127 | 12/1908 | Passmore | 138/172 |
| 1,442,160 | 1/1923 | Lachman | 138/153 |
| 1,472,518 | 10/1923 | Gillette et al. | 138/172 |
| 1,677,714 | 7/1928 | Frease | 138/172 |
| 3,110,753 | 11/1963 | Witort | 138/172 |

FOREIGN PATENT DOCUMENTS

| | | | |
|---|---|---|---|
| 484455 | 5/1938 | United Kingdom | 228/132 |

*Primary Examiner*—Richard K. Seidel
*Assistant Examiner*—Samuel M. Heinrich
*Attorney, Agent, or Firm*—Dickstein, Shapiro & Morin

[57] ABSTRACT

The strengthening and stiffening of long, curved or tapered tubes is achieved by using internal strengthener. The strengthening element conforms to the internal shape of the tube as it is inserted into the tube. The parts of the strengthening element which are then in contact with the inside of the tube have pre-formed welding material attached to them; a solid connection between the strengthener and the tube is achieved by selective heating, welding or by blowing adhesive material through the tube.

If a tube has the non-welded strengthener in place, the forming or bending of the tube may proceed, since the strengthener takes the form of the tube at any stage of forming. The process is especially suitable for tubes with different cross-sections along their length.

After the strengthener has assumed its final position within the formed tube, a rotational prestress or torque applied to the strengthener before welding is a means of prestressing the tube in one helical direction, which is followed by the welding step. In a long tube, after the strengthener has assumed its final position within the tube, the strengthener can be longitudinally prestressed while the tube is formed, thus providing a longitudinally prestressed tube after the welding step. The channels created by the welding process may be used to transmit fluids or gases.

6 Claims, 12 Drawing Sheets

PROCESS FOR INTERNALLY STRENGTHENING TUBES

BACKGROUND

1. Field of the Invention

The present invention relates to a method and process for strengthening and stiffening tubes and pipes using internal stiffening elements which are welded after such elements achieve their final form and position with in the tube. In particular, the method is especially suitable for strengthening tubes with different cross sections along their length, or bent or helically formed tubes.

2. Background of the Prior Art

Except for extruded light-metal products, no method or process for internally strengthening tubes with different cross-sections along their length or tubes with bends or spirals, while allowing for reductions in tube wall thickness and/or tube weight, is known. No process for bending or otherwise forming tubes with stiffening elements already in place is known.

The following methods of joining elements and partitions within a tube by use of heat or adhesives are known: (1) painting of a soldering mixture on the parts to be joined, followed by heating of the parts in a reducing atmosphere (Noble, GB- No. 484,455), (2) welding by use of a binding material in wire form inserted into the tube, after which the tube is heated in a reducing atmosphere to the melting point of the binding material (Gillette et al, U.S. Pat. No. 1,472,518), and the brazing of the edges of the strengthening element near each end of the tube for a slight distance (Passmore, U.S. Pat. No. 908,127). In the present invention, one of the preferred methods of welding the strengthening elements in the tube, that of induction warming of the joints which have pre-formed welding or soldering material firmly attached to the strengthening element or forming an integral part thereof, in the presence of the normal atmosphere, is not known from the prior art.

SUMMARY AND OBJECTS OF THE INVENTION

It is therefore an object of this invention to provide a method and process for the strengthening and internally stiffening of tubes and pipes, especially of very long tubes or those with differing cross-sections along their length, or those with bends or spirals.

A further object of the invention is to provide for internal stiffeners with a helical prestress within a bent or helically-formed tube.

Yet another object of the invention is to achieve internal stiffening of tubes with a longitudinal prestress. The forming and bending of such tubes with stiffening elements in their internal position, without damaging the tube in the forming process, in possible by the use of this invention.

The foregoing objects are achieved by the present invention, which provides for internally stiffening and strengthening of tubes and pipes both before and after their forming, by pulling or pushing through the tube a self-positioning and self-adapting stiffening element, which forms a solid connection with the tube at the points or places of contact by an appropriate welding, heating, glueing or similar process. The advantage of this method is the production of stronger, lighter tubes than those with the same wall thickness and diameter which are not so internally stiffened and strengthened.

Very long, strengthened and/or stiffened tubes and pipes can be produced by this method.

Further, the present invention achieves the foregoing objects by allowing the stiffening element to be pushed or pulled through a tube after it has been formed. The advantage of the method is that formed tubes, or those with differing cross-sections along their length, can be internally stiffened and/or strengthened, while tubes with already connected stiffening elements would damage the stiffener or would be themselves damaged during the forming process.

Further, the present invention achieves the foregoing objects by allowing the connection between the tube and the stiffening element to be created via heating of the points or places of contact between said element and said tube. The advantage of this method is that there is much greater freedom for said element to adapt to the contour and inner surface of said tube when a welding and/or heating process is applied, instead of using positioning mechanisms and/or mechanical fastening methods. In addition, the welding connection is the firmest and solidest method for this strengthening purpose.

Further, the present invention achieves the foregoing objects by allowing the connection between the tube and the stiffening element to be created by blowing or injecting liquid plastic, glue or a similar material into the tube opening. The advantage of this method is that there is much greater freedom for said element to adapt to the contour and inner surface of said tube when a plastic welding or glueing process is applied, instead of using positioning mechanisms and/or mechanical fastening methods. In addition, the glueing process is economical and forms a first and solid connection for plastic and similar tube materials.

Further, the present invention achieves the foregoing objects by allowing the stiffening element to be totally within the tube before and during the forming of said tube, said forming being bending, expansion or compression of parts of said tube or other similar methods, so that said element positions and adapts itself to the shape of said tube and said element is totally in connection with the inner wall of said tube. The advantage of this method is that said tube and said element will not be damaged during said forming, while a tube with an already connected stiffener will knick, break, be otherwise damaged, or will be weakened.

Further, the present invention achieves the foregoing objects by allowing both ends of the stiffening element to be solidly held by a suitable mechanism after said element has achieved its final radial and longitudinal position within the tube. By twisting the ends of said element is opposite directions, a definite prestressing torque will exist, after which a suitable welding or glueing process will be carried out. The advantage of this method is that a radial prestress can be created in either the left or right hand direction; by performing the process in stages, multiple radial stresses can be built into the strengthened tube. One application for the method is for the main support of a freestanding spiral staircase.

Further, the present invention achieves the foregoing objects by allowing both ends of the stiffening element to be solidly held by a suitable mechanism after said element has achieved its final radial and longitudinal position within the tube. By pulling the ends of said element in opposite directions with a suitable mechanism, the tube can be bent or otherwise formed, after which a suitable welding or glueing process is carried out. The advantage of this method is that a longitudinal prestress can be created in the strengthened and stiffened tube. One application would be for very long tubes and pipes, which can thus be used in the horizontal direction to carry heavy loads.

DETAILED DESCRIPTION

Figure 1:
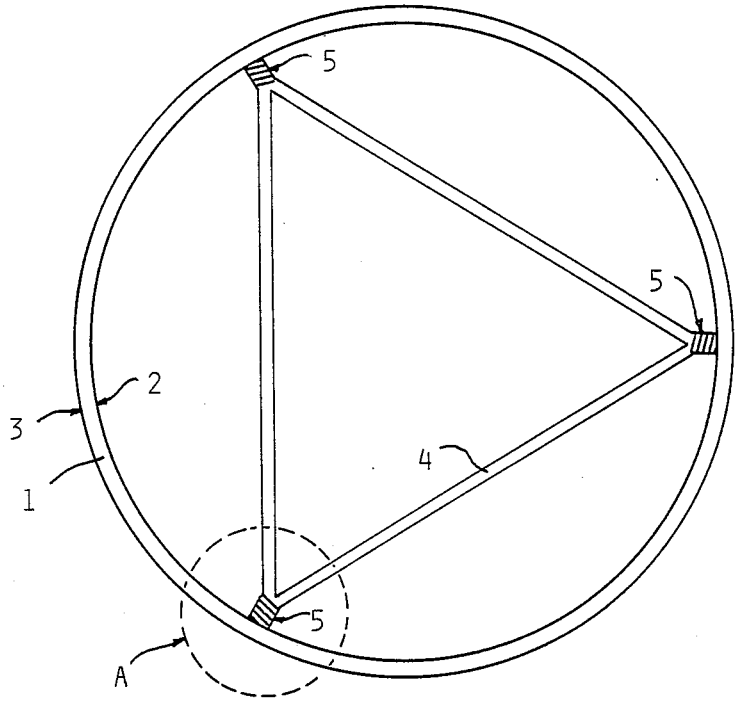
FIG. 1 is a first example of the stiffening element within a tube.
Figure 2:
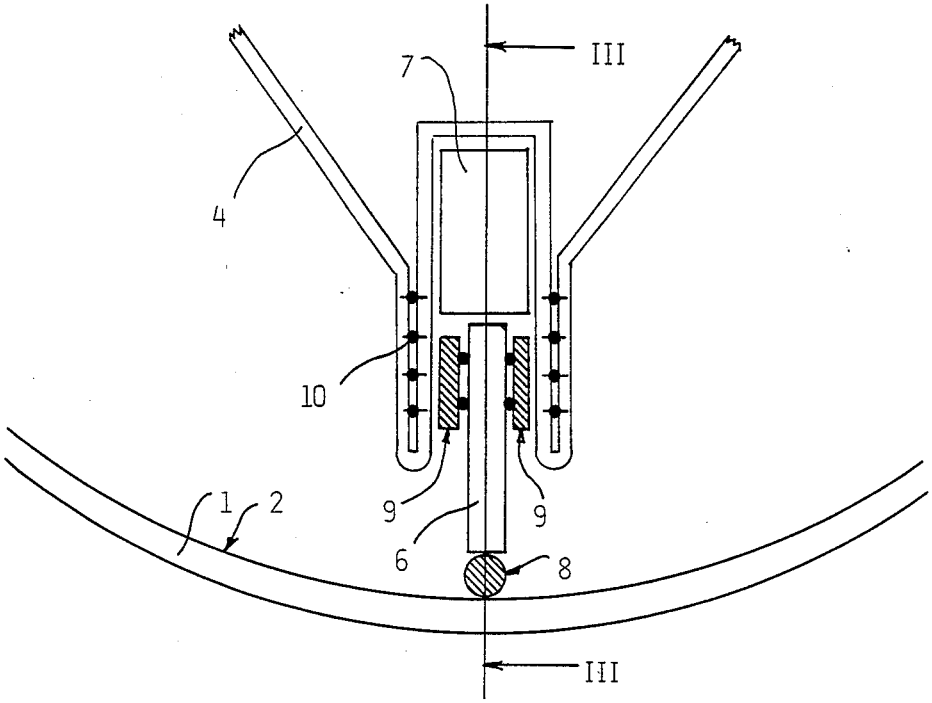
FIG. 2 is an enlargement of a cross-section of FIG. 1.

In FIG. 1, a possible strengthening method for tubes is represented. Before the final connection step, the stiffener 4 is pulled through the tube 1 with its inner wall 2 and outer wall 3. In this representation, the connection method is welding; the connection mechanisms having welding material firmly attached. FIG. 2 is an enlargement of the cross-section A in FIG. 1.

In FIG. 2, the stiffener 4 and its connection parts in contact with the inner wall 2 of the tube 1 is shown. The edges of the stiffener are so formed and spot welded at the points 10 that a slot in the stiffener exists. A connecting element 6 with firmly connected welding material 8 and 9 is free to move within the slot. In order to provide for constant contact between the inner wall 2 of the tube and the welding rod 8, the element 6 remains under pressure of a wave-formed flat spring 7. During the warming process, the welding material 9 flows in the slot between the stiffening element 4 surfaces and the outside surface of the element 6, which is always within the slot. At the same time, the welding material 8 flows between the element 6 and the inner surface 2 of the tube. After cooling, a solid connection between the connection mechanisms 5 of FIG. 1 and the contact points or lines on the inner wall of the tube exists. The cross-section designated by Roman Numeral III in FIG. 2 through the stiffening element 4 and the connection parts 6, 7 and 8 is illustrated in detail in FIG. 3.

Figure 3:
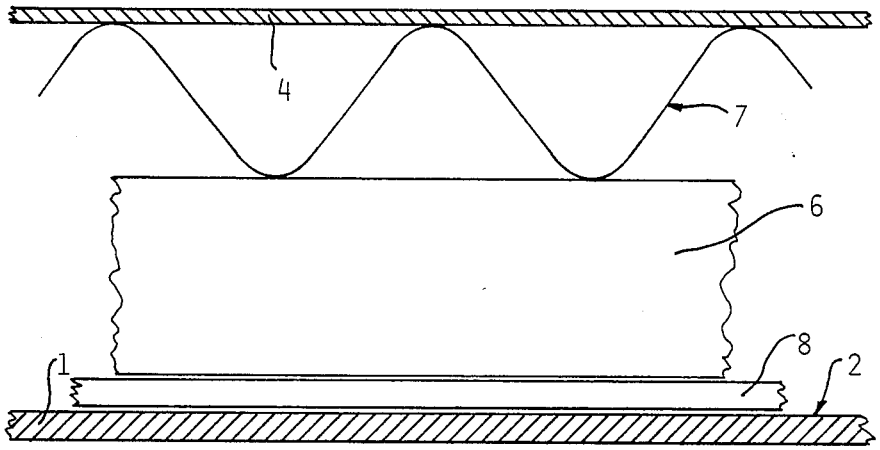
FIG. 3 is a cross-section of the stiffening element shown in FIG. 2.

FIG. 3 illustrates how the wave-shaped leaf spring 7 exerts its force between the stiffener 4 and the connection part 6 with its connected welding material, in order to guarantee that the welding rod 8 and the inner wall 2 of the tube are continually in positive contact.

Figure 4:
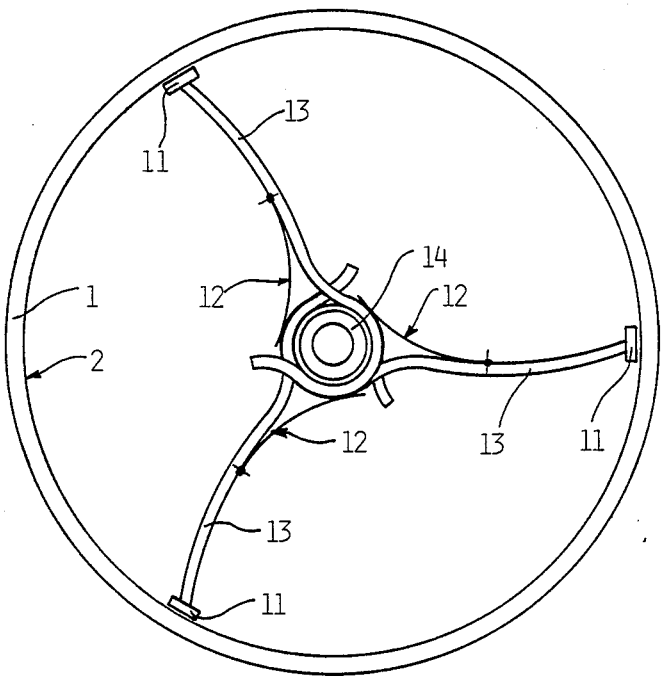
FIG. 4 is a second example with the stiffening element not yet in solid contact with the tube.
Figure 5:
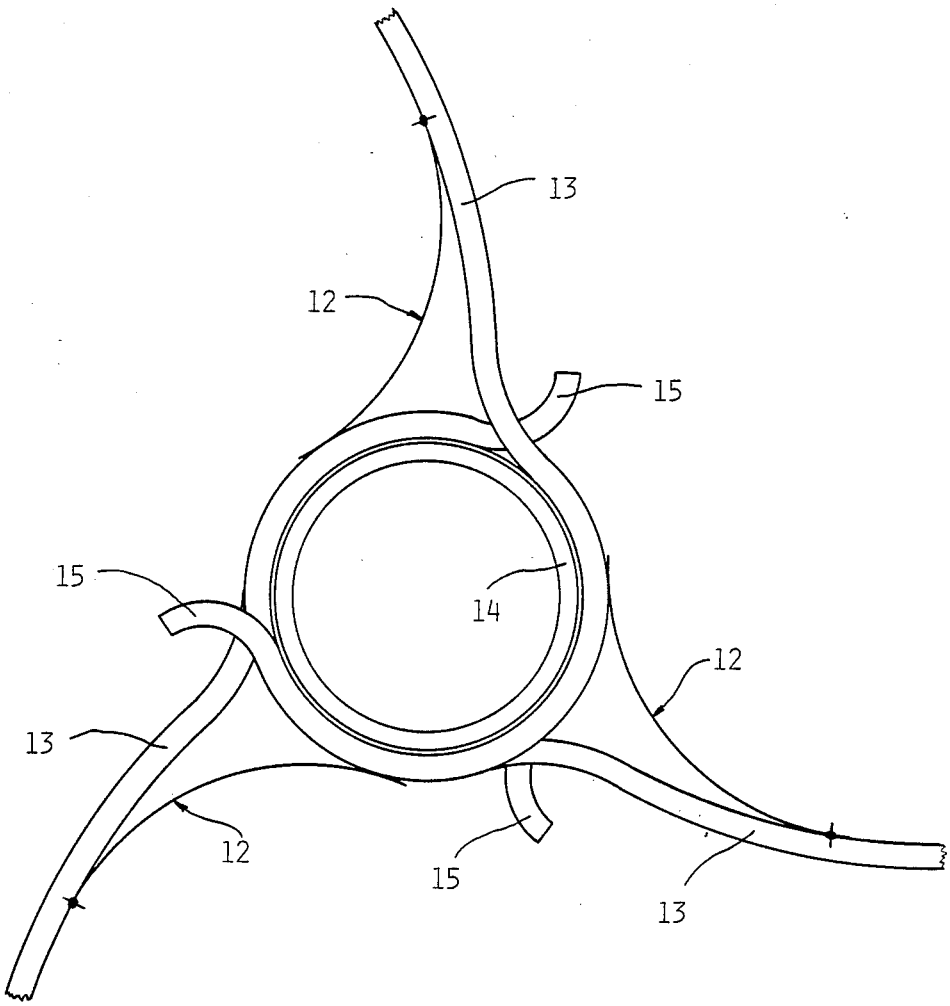
FIG. 5 is a detail drawing of FIG. 4 showing the central portion of the stiffening element including the rotation stops.

FIG. 4 illustrates a possible strengthening of a tube by use of three connected strengthening elements 13. The three connecting ends of the elements are kept in place in the center via a tube 14 consisting of welding material. On the outer ends of the strengtheners 13 are found welding material 11 in firm connection with said strengtheners. While the strengthener is pulled through the tube 1, the elements 13 adapt themselves to the inner surface 2 of the tube. The ring shaped inner ends of said elements 13 have formed limits, to keep the elements 13 separated. To guarantee that the outer ends of said elements 13 stay in positive contact with the inner wall 2 of the tube during the welding step, spot-welded leaf springs 12 keep pressure on said elements 13. Under the combined action of the rotation stops and the strong leaf springs 12, said strengthening elements 13 rotate around said tube 14 while the strengthener is pulled through the tube 1. After the strengthener has adapted itself to the inner contour of the tube 1, all or selective portions of the elements 13 are heated, including the tube 14 of welding material. The welding material in the center melts, and after cooling the ends of said elements 13 in the center and those in contact with the inner wall 2 of the tube 1 are solidly connected to their respective mating parts. FIG. 5 is an enlargement of the central area B of FIG. 4.

In FIG. 5, the rotation stops 15 are illustrated. By variable bending of the stops during the manufacturing of the strengthening elements 13, the angle of the stops can be made to adapt to the fitting requirements of the strengthener. The ring-formed parts and the stops are manufactured by well known methods. The tube 14 of welding material can be either thin or thick-walled, depending on use, and may, but is not required to be a structural element of the central portion of the strengthener before the welding step.

Figure 6:
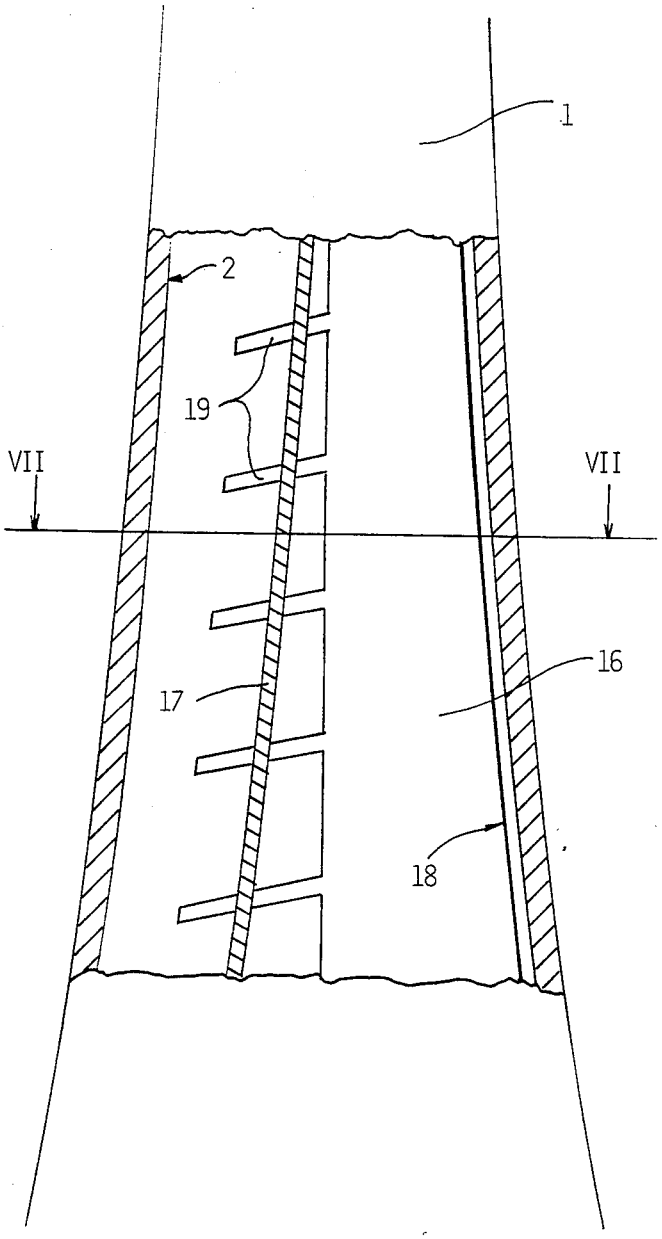
FIG. 6 is a third example of the strengthening of a long, tapered tube.

FIG. 6 illustrates the strengthening of a long, tapered tube with a round, oval or other irregular cross-section; in this example, a round cross-section is assumed. The strengthener consists mainly of two elements 16 and 17, which are stamped from flat sheet metal. The elements 16 and 17 have together three edges in contact with the inner wall 2 of the tube 1, and have along their edges welding material in firm contact. The welding rod 18 on the edge of element 16 is illustrated in the figure. The stamped, teeth-like parts 19 of said element 16 fit in the punched slots of said element 17. The cross-section identified with Roman Numeral VII through the said elements 16 and 17 as well as said welding rod 18 is shown in detail in FIG. 7.

Figure 7:
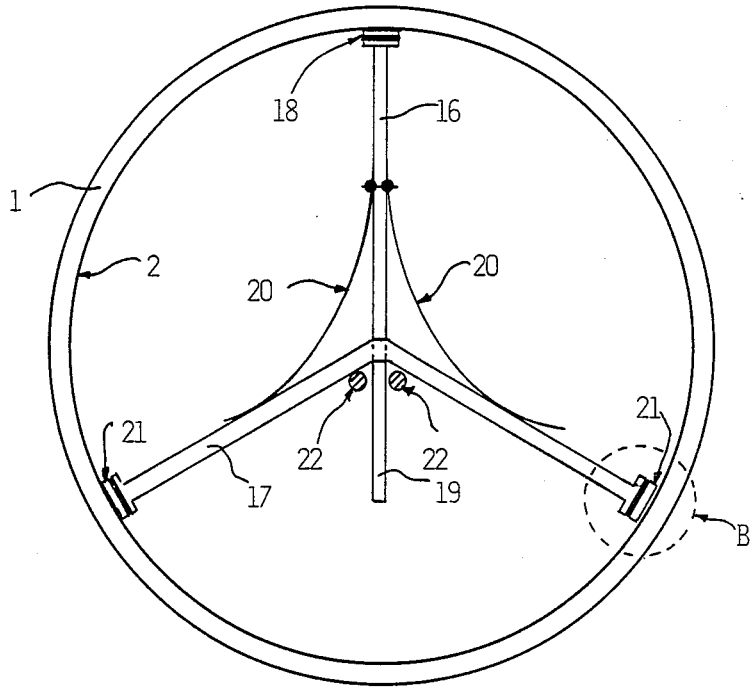
FIG. 7 is a cross-section through the stiffening element shown in FIG. 6.
Figure 12:
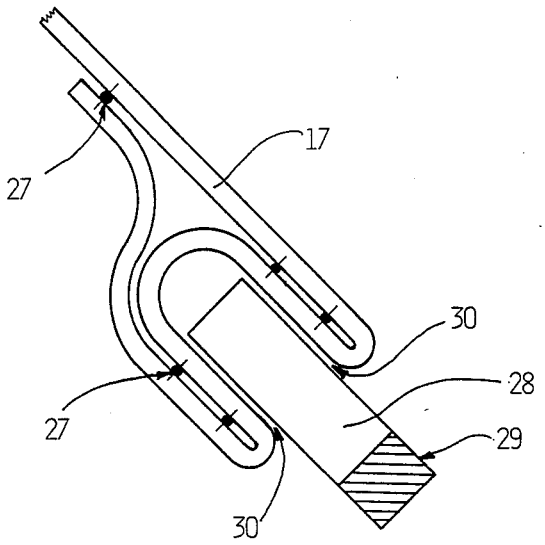
FIG. 12 is an enlargement of an edge of the stiffening part shown in FIG. 7 showing the contact point or line between the stiffening element with welding material in place and the inner wall of the tube before the welding step.
Figure 13:
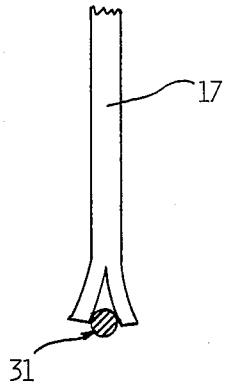
FIG. 13 is a second example of an edge of a stiffening element with welding material in place, as shown in the enlargement B of FIG. 7.

In FIG. 7, in combination with FIG. 6, it is illustrated how the flat strengthening element 16 adapts itself to the inner wall 2 of a tapered tube 1, and how the teeth-like parts 19 fit through the slots of strengthening element 17. The two leaf springs 20 guarantee that the edge 18 of said element 16, which has welding material firmly attached, remains firmly in contact with the inner wall 2 of the tube, and that said element 16 retains approximately it perpendicularity with a fictitious line between the strengthener edges 21. At the start of the process of pulling the strengthener through the tube 1, from the end with the largest opening toward that end with the smallest opening, the adapting teeth-like parts 19 sit loose within the mating slots in the bent strengthening element 17 (said slots are marked 23 in FIG. 9). Under the influence of the steadily decreasing tube cross-section, the said parts 19 pass further and further through the said slots 23. After the strengthening element has reached its final position within the tube, the connecting parts with welding material are heated, and after cooling the solid connection exists. The position and connecting method for attaching the welding material 21 and 22 are detailed in FIGS. 8, 12, 13 and 14. As possible variations for attaching the welding material, FIGS. 12, 13*a* and 13*b* show on enlargement of the cross-section B of FIG. 7.

Figure 8:
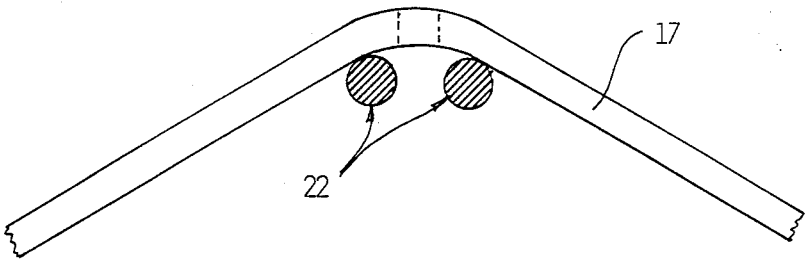
FIG. 8 is a cross-section through the bent element of the stiffener shown in FIG. 9 with welding material firmly attached.

FIG. 8 shows the central part of the bent stiffening element 17 of the strengthener in FIG. 7. The position of the welding rods on either side of the bend in the area of the adaptation slots 23 shows that there is some degree of angular freedom for the adaptation of the strengthening element 16, but also that they are near enough to said element 16 to allow for a positive weld.

Figure 9:
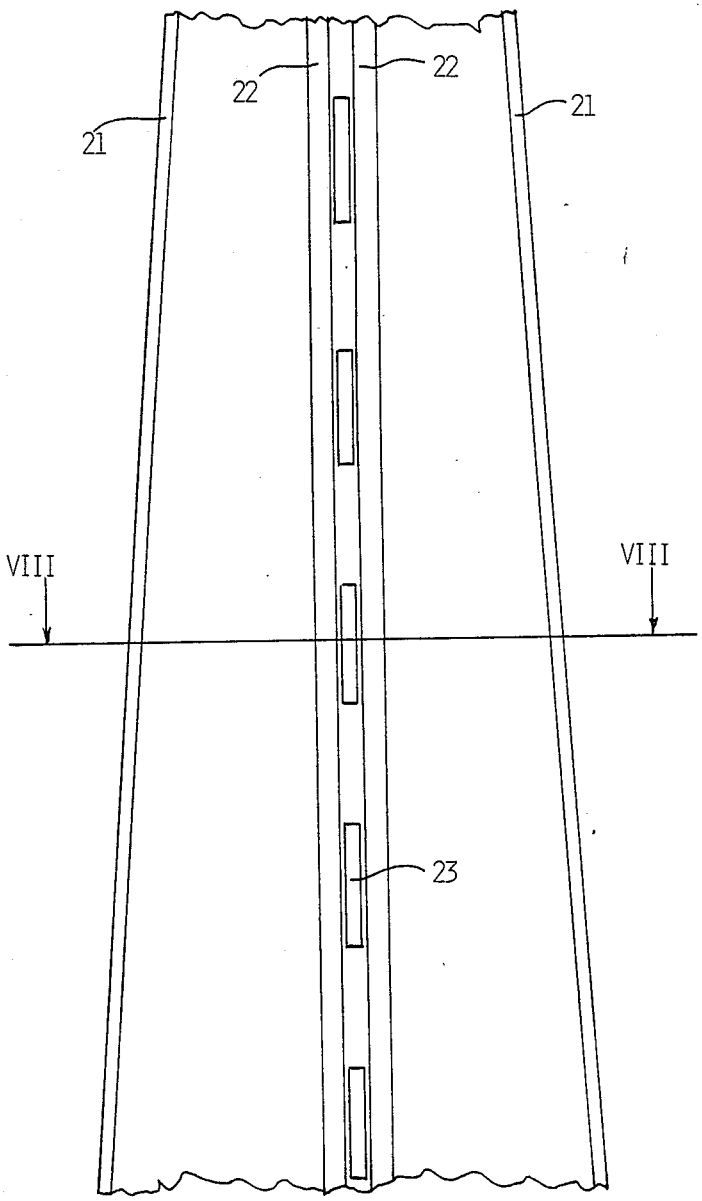
FIG. 9 shows the form of the bent stiffener shown in FIG. 6 with welding material in place and the punched adaptation holes for the stiffening part shown in FIG. 10.

FIG. 9 shows the bent strengthening element 17 of FIG. 6 with the adaptation slots 23 between the welding rods 22, which are presented in detail in FIG. 8. The edges 21 of said element 17 are also shown, and are shown in detail in FIGS. 12, 13 or 14. The cross-section marked with Roman Numeral VIII illustrates said bent element 17, which is partly shown in detail in FIG. 8.

Figure 10:
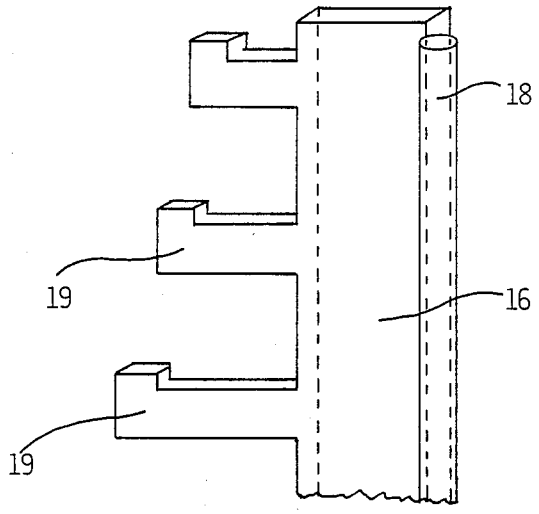
FIG. 10 shows the flat stiffening part which fits into the punched holes shown in the stiffener part of FIG. 9.
Figure 11:
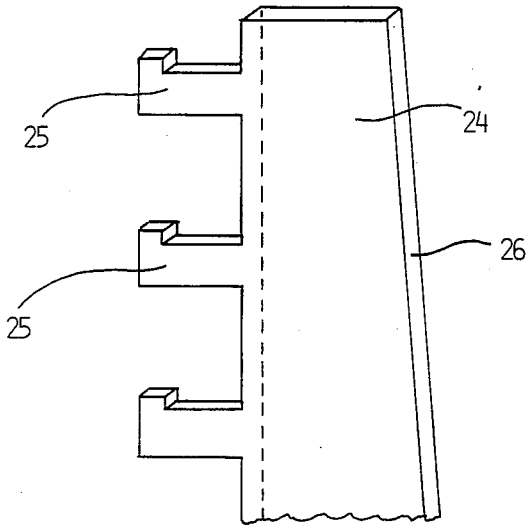
FIG. 11 is a second example of the flat adaptation stiffening part illustrated in FIG. 6.

FIGS. 10 and 11 illustrate two possible variations of the flat stiffening element 16 from FIG. 6. In FIG. 10, a possible position of the welding material 18 on the edge of said element 16 is shown. The stiffening elements 16 and 24 in FIGS. 10 and 11 resp., show definitely how these elements adapt themselves to the inner wall of the tube as well as to the mating stiffener 17 of FIG. 7. By the first variation in FIG. 10, the adaptation parts 19 pass further and further through the mating slots of the strengthening element 17 and away from the contact of the welding material 18 with the inner wall of the tube, the further the strengthener is pulled through the tube. By the second variation in FIG. 11, the adaptation parts 25 do not pass much further through the mating slots; instead, the wedge formed edge 26 of the stiffener 24 matches the inner wall of the tube, the further the strengthener is pulled through the tube. In FIG. 12, a possible variation of the edge 21 of the strengthening element 17 from FIG. 7 is shown. Said element 17 is formed, and as shown, spot welded at points 27. Inside of the thereby formed slot, a bar 28 with welding material 29 firmly attached is pressed or placed so that it keeps its position. During the heating process, the welding material flows into the planned mating positions 30 as well as between the bar 28 and the inner wall of the tube, thus on cooling forming solid connections.

Figure 14:
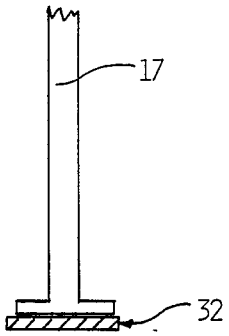
FIG. 14 is a third example of an edge of a stiffening element with welding material in place, as shown in the enlargement B of FIG. 7.

In FIGS. 13 and 14, possible second and third variations of the edge 21 of the strengthening element 17 from FIG. 7 are shown. In FIG. 13, the edge of said element 17 is split lengthwise, as shown; the next step is to force welding material 31 into the slit, possibly via selective heating of one or both parts and via pressure. In FIG. 14, the edge of said element 17 is flattened via any of the well known processes; afterwards, a flat welding rod 32 is attached to the flattened edge by the use of pressure or heating.

While the strengthened tubes and pipes of the invention require additional manufacturing steps and additional material for the internal strengthener and/or stiffener elements, it is possible to selectively create lighter and stronger tubes for a variety of applications. A number of applications which were heretofore impossible can be satisfied by using the teachings of this invention. In particular, the internally strengthening of long, small diameter tubing, and especially those with variable cross-sections along their length, can be carried out by using the procedures and methods described. The prestressing of tubes in one or more directions and positions, while keeping tube weight to a minimum, has not been possible in the past. This ability to prestress tubes, which simultaneously are strengthened by the teachings of this invention, and especially the forming of tubes with the strengthening elements in place within the tubes, are other important contributions of this invention.

While this invention has been described with reference to a number of possible variations, it is by no means limited thereto. Rather, the scope of the invention is limited only insofar as defined by the following set of claims and further includes all equivalents thereof.

What is claimed is:

1. A method of internally strengthening and stiffening a tube which has a cross-section which is regular along its length and symmetrical about its longitudinal axis but which is bent or otherwise not straight, or a tube whose cross-section along its length is irregular or has an otherwise non-symmetrical form and which is either straight, bent or has another form lengthwise, accomplishing a solid connection between a strengthening element comprising a plurality of parts and the inner walls of the tube by the process of heating or other welding or gluing processes, characterized by inserting a self-adapting, self-positioning strengthening element into said tube, by the parts of said strengthening element adapting themselves continually to the inner contours of said tube, and finally by establishing said solid connection between said tube and those points and parts of said strengthening element which are either in direct contact with said tube or in contact with other selected points close to the inner walls of said tube, as well as between the parts of said strengthening element which move relative to each other while said strengthening element self-adapts itself within said tube.

2. The method as specified in claim 1, characterized by inserting said strengthening element partly or fully into said tube, by bending or otherwise forming the tube, and finally by accomplishing said solid connection.

3. A method of internally strengthening and stiffening a tube which has a cross-section which is regular along its length and symmetrical about its longitudinal axis but which is bent or otherwise not straight, or a tube whose cross-section along its length is irregular or has an otherwise non-symmetrical form and which is either straight, bent or has another form lengthwise, accomplishing a solid connecting between a strengthening element comprising a plurality of parts and the inner walls of the tube by the process of heating or other welding or gluing processes, characterized by inserting a self-adapting, self-positioning strengthening element into said tube, by the parts of said strengthening element adapting themselves continually to the inner contours of said tube, and finally by establishing said solid connection between said tube and those points and parts of said strengthening element which are either in direct contact with said tube or in contact with other selected points close to the inner walls of said tube, as well as between the parts of said strengthening element which move relative to each other while said strengthening element self-adapts itself, within said tube, said method further characterized by applying a rotational prestress as torque to the ends of said strengthening element within said tube, and finally by accomplishing said solid connection while continuously applying said torque.

4. A method of internally strengthening and stiffening a tube which a cross-section which is regular along its length and symmetrical about its longitudinal axis but which is bent or otherwise not straight, or a tube whose cross-section along its length is irregular or has an otherwise non-symmetrical form and which is either straight, bent or has another from lengthwise, accomplishing a solid connection between a strengthening element comprising a plurality of parts and the inner walls of the tube by the process of heating or other welding or gluing processes, characterized by inserting a self-adapting, self-positioning strengthening element into said tube, by the parts of said strengthening element adapting themselves continually to the inner contours of said tube, and finally by establishing said solid connection between said tube and those points and parts of said strengthening element which are either in direct contact with said tube or in contact with other selected points close to the inner walls of said tube, as well as between the parts of said strengthening element which move relative to each other while said strengthening element self-adapts itself within said tube, said method further characterized by inserting said strengthening element partly or fully into said tube, by bending or otherwise forming said tube, by applying a rotational prestress or torque to the ends of said strengthening element within the tube, and finally by accomplishing said solid connection while continuously applying said torque.

5. A method of internally strengthening and stiffening a tube which has a cross-section which is regular along its length and symmetrical about its longitudinal axis but which is bent or otherwise not straight, or a tube whose cross-section along its length is irregular or has an otherwise non-symmetrical form and which is either straight, bent or has another form lengthwise, accomplishing a solid connecting between a strengthening element comprising a plurality of parts and the inner walls of the tube by the process of heating or other welding or gluing processes, characterized by inserting a self-adapting, self-positioning strengthening element into said tube, by the parts of said strengthening element adapting themselves continually to the inner contours of said tube, and finally by establishing said solid connection between said tube and those points and parts of said strengthening element which are either in direct contact with said tube or in contact with other selected points close to the inner walls of said tube, as well as between the parts of said strengthening element which move relative to each other while said strengthening element self-adapts itself, within said tube, said method further characterized by holding both ends of said strengthening element and pulling said ends to create a longitudinal prestress of said strengthening element within the tube, and finally by accomplishing said solid connection while continuously applying said prestress.

6. A method of internally strengthening and stiffening a tube which has a cross-section which is regular along its length and symmetrical about its longitudinal axis but which is bent or otherwise not straight, or a tube whose cross-section along its length is irregular or has an otherwise non-symmetrical form and which is either straight, bent or has another form lengthwise, accomplishing a solid connecting between a strengthening element comprising a plurality of parts and the inner walls of the tube by the process of heating or other welding or gluing process, characterized by inserting a self-adapting, self-positioning strengthening element into said tube, by the parts of said strengthening element adapting themselves continually to the inner contours of said tube, and finally by establishing said solid connection between said tube and those points and parts of said strengthening element which are either in direct contact with said tube or in contact with other selected points close to the inner walls of said tube, as well as between the parts of said strengthening element which move relative to each other while said strengthening element self-adapts itself, within said tube, said method further characterized by inserting said strengthening element partly or fully into said tube, by holding both ends of said strengthening element and pulling said ends to create a longitudinal prestress of said strengthening element within the tube, by then bending or otherwise forming said tube in such a manner that a definite stress will exist between said tube and said strengthening element after connecting them solidly together, and finally accomplishing said solid connection while continually applying said prestress.

* * * * *